US005493739A

United States Patent [19]

Bezdek

[11] Patent Number: 5,493,739

[45] Date of Patent: Feb. 27, 1996

[54] THERMOSTATIC TOILET FLUSH VALVE

[76] Inventor: William J. Bezdek, 2861 Hagadorn Rd., Mason, Mich. 48854

[21] Appl. No.: 5,118

[22] Filed: Jan. 15, 1993

[51] Int. Cl.[6] ..... A47K 4/00

[52] U.S. Cl. ..... 4/638

[58] Field of Search ..... 4/663, 664, 665, 4/597, 605, 546, 559, 638, 668; 137/337

[56] References Cited

U.S. PATENT DOCUMENTS

| | | | |
|---|---|---|---|
| 2,716,424 | 8/1955 | Watts | 137/337 X |
| 2,830,612 | 4/1958 | Taylor | 137/337 |
| 2,842,155 | 7/1958 | Peters | 137/337 |
| 2,900,645 | 8/1959 | Rom | 137/337 X |
| 3,318,449 | 5/1967 | Jennings et al. | 4/665 X |
| 3,776,261 | 12/1973 | Houghton | 137/337 |
| 3,783,897 | 1/1974 | Pegg et al. | 137/337 X |
| 3,995,327 | 12/1976 | Hendrick | 4/665 X |
| 4,133,057 | 1/1979 | Rivetti | 4/664 |
| 4,554,688 | 11/1985 | Puccerella | 4/668 |
| 4,563,780 | 1/1986 | Pollack | 4/597 X |
| 4,606,325 | 8/1986 | Lujan, Jr. | 126/362 |
| 4,778,104 | 10/1988 | Fisher | 236/80 R |
| 4,854,499 | 8/1989 | Neuman | 4/605 X |
| 4,924,536 | 5/1990 | Houghton | 4/665 |
| 5,205,318 | 4/1993 | Massaro et al. | 137/337 |

*Primary Examiner*—Robert M. Petsuga
*Attorney, Agent, or Firm*—Ian C. McLeod

[57] ABSTRACT

A toilet flush water supply control unit (10) which enables hot water to be immediately available at a hot water faucet (56), is described. The control unit (10) is formed from a first fluid conduit (12) and a second fluid conduit (20). The first fluid conduit provides a passage (12C) between the cold water supply (52) and the toilet flush tank (40). An intermediate opening (12D) in the first fluid conduit is opened and closed by a thermostatic device (21) mounted in the second fluid conduit. The thermostatic device allows cool water in the hot water system to flow into the first fluid conduit and thus into the toilet flush tank. Once hot water reaches the thermostatic device, the device closes. A valve (28) which is manually controlled by a handle (29) attached to the toilet flush tank, allows the user to turn the control unit on and off. The unit saves water and at the same time provides convenience of use.

20 Claims, 4 Drawing Sheets

THERMOSTATIC TOILET FLUSH VALVE

BACKGROUND OF THE INVENTION (1) Field of the Invention

The present invention relates to a toilet supply water supply control unit. In particular, the present invention relates to a toilet flush water supply control unit wherein heated water which has cooled down in the plumbing system is used to flush the toilet. The control unit contains a valve to turn on the unit and a thermostatic device within the unit to allow cool water in the heated water piping system to enter the toilet flush tank and then to prevent hot water in the piping system from entering the toilet flush tank.

In the standard plumbing systems, hot water is supplied from a hot water source, usually a hot water heater through the hot water piping system and into the hot water faucet. Once the hot water faucet is shut off new hot water is no longer entering the system. Therefore, the hot water remaining in the piping system is left to cool down. Thus, when the hot water faucet is once again turned on, the cool water in the piping system must be drained out before new hot water from the hot water supply can reach the faucet. Normally, the cool water is unwanted and is allowed to run down the drain unused.

To prevent the waste of the cool water in the hot water piping system, a thermostatic valve with a control unit is located between the hot water faucet and the toilet flush tank. When the control unit is in the on position, flushing the toilet causes the cool water to flow through the hot water piping system and into the toilet flush tank. Drainage of the cool water into the toilet flush tank allows new hot water to reach the thermostatic device within the control unit. Upon sensing the hot water, the thermostatic device closes preventing the hot water from entering the toilet flush tank. At that point, all cool water is out of the hot water piping system. Therefore, when any hot water faucets in the bathroom are turned on, hot water is immediately available.

(2) Prior Art

The prior art has described several plumbing systems for conserving water through the use or reuse of normally wasted water. Illustrative of water conservation plumbing systems are U.S. Pat. Nos. 3,318,449 to Jennings et al; 3,995,327 to Hendrick; 4,554,688 to Puccerella and 4,924,536 to Houghton.

Jennings et al describes a water reuse system. Drainage water from the sink, bathtub, etc. which is slightly impure, is fed through a layered filter and into a main storage tank. From the main storage tank the filtered water is either sent to a toilet flush tank or an auxiliary flush tank in order to reuse the filtered water to flush the toilet. The filtered water in the main storage tank may also be diverted for other uses where the purity of the water is not an essential element.

Hendrick describes an automated toilet system wherein the toilet flush tank has an inner and outer tank. The inner tank is filled by drainage water directly from a sink or drinking fountain and is supplemented by the water in the outer tank when needed to flush the toilet.

Puccerella describes a water saving system wherein a sensor determines the temperature of the water immediately upstream from the faucet. In order to achieve a predetermined water temperature at the faucet, the sensor opens a valve which allows the cooled down water in the pipes to be diverted back to the hot water heater to be reheated. The sensor closes the feedback valve once the water has reached the desired temperature.

Houghton describes a water conservation system wherein cooled down water in the pipes is diverted to a storage tank for use in supplying the toilet flush tank for flushing the toilet. The water is diverted by a manually operated valve or a time delay valve which is closed once it has been estimated that enough time has passed to empty the pipes of the cooled water.

In addition, other prior art references, including Puccerella above, describe the use of thermostatic devices to regulate the temperature of the water to a faucet. Illustrative are U.S. Pat. Nos. 4,133,057 to Rivetti and 4,778,104 to Fisher.

None of the above devices create a system of conserving water which is easily and economically installed in an existing plumbing system and is automatically controlled by the temperature of the water thereby reducing the need for human interaction and producing the added benefit of having hot water instantly.

OBJECTS

It is therefore an object of the present invention to provide a water conservation system which conserves water by using cool water in the pipes from the hot water supply to flush the toilet. Further, it is an object of the present invention to provide a method for controlling the supply of water to a flush toilet. Furthermore, it is the object of the present invention to provide a water conservation system wherein a valve is connected between the hot water supply for the bathroom faucets and the cold water supply for the toilet flush tank to enable the user to easily activate the system and thus divert the cool water to the toilet flush tank. Still further, it is an object of the present invention to provide a water conservation system wherein a thermostatic device located between the hot water supply and the toilet flush tank prevents hot water from going into the flush tank. Further, it is an object of the invention to provide a water conservation system which can be easily and economically installed in an existing plumbing system. Furthermore, it is an object of the invention to provide a water conservation system which conserves water and allows the user to have hot water instantly upon turning on the hot water faucet.

DETAILED DESCRIPTION OF PREFERRED EMBODIMENT

Figure 1:
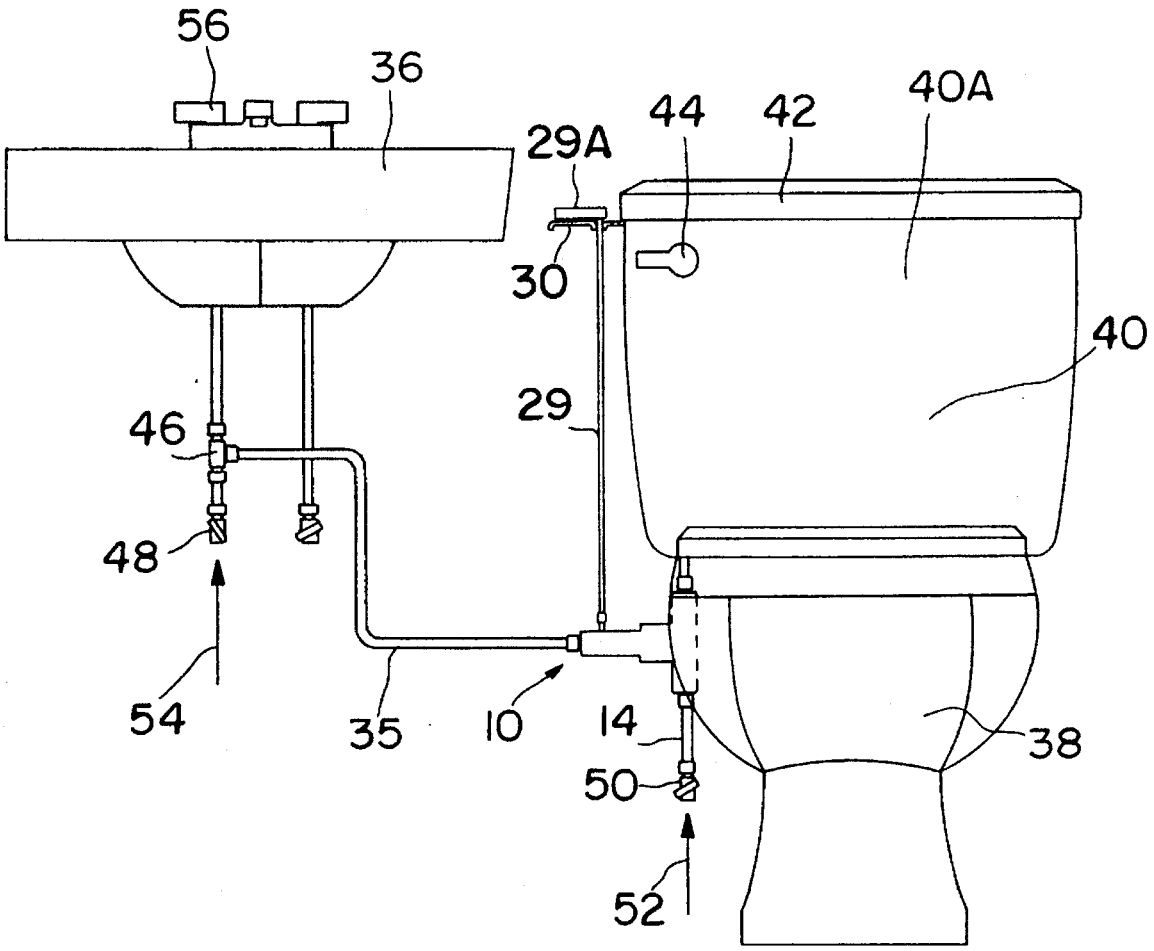
FIG. 1 is a front view of the conventional bathroom plumbing system with a toilet 38 and a lavatory 36 and with the T-shaped control unit 10 connected between the hot water supply 54 and the cold water supply 52 and the toilet flush tank 40.

The present invention relates to a toilet flush water supply control unit which comprises: a first fluid conduit having a passage with an inlet and outlet for directing cold flush water into the toilet and with an intermediate opening in the conduit into the passage; a first check valve means mounted adjacent to the inlet of the first fluid conduit to the passage; a second fluid conduit mounted on and closing the opening in the first fluid conduit; a thermostat means mounted in the second fluid conduit which is open when the water is cool and closed when the water is hot; and a second check valve means mounted in the second fluid conduit preventing the flow of the water through the intermediate opening and out of the second conduit and allowing flow of the water into the conduit wherein the control unit allows cool water from a hot water supply to flow through the second conduit until the water becomes heated and then the thermostat means closes the second conduit when hot water moves through the second fluid conduit to the first fluid conduit and thereafter water is supplied to the toilet only through the passage between the inlet and outlet of the first fluid conduit.

In particular the present invention relates to a system for providing cool water from a hot water supply to a toilet which comprises: a first fluid conduit having a passage with an inlet and outlet for directing cold flush water into the toilet and with an intermediate opening in the conduit into the passage; first check valve means mounted adjacent to the inlet of the first fluid conduit to the passage; a second fluid conduit mounted on and closing the opening in the first fluid conduit; a thermostat means mounted in the second fluid conduit which is open when the water is cool and closed when the water is hot; a second check valve means mounted on the second fluid conduit preventing the flow of water through the intermediate opening and out of the second conduit and allowing flow of the water into the second conduit wherein the control unit allows cool water from a hot water supply to flow through the second conduit until the water becomes heated and then the thermostat means closes the second conduit when hot water moves through the second fluid conduit to the first fluid conduit and thereafter water is supplied to the toilet only through the passage between the inlet and outlet of the first fluid conduit; pipes supplying cold water to the inlet and through the passage of the first fluid conduit to the toilet and cool water from the hot water supply to the second fluid supply conduit; and a flush toilet having a flush water supply line with the first conduit of the circuit mounted in the supply line, wherein cool water from the hot water supply flows through the second fluid conduit to the first fluid conduit until the thermostat means closes the first fluid conduit.

Finally, the present invention relates to a method for controlling the supply of water to a flush toilet which comprises: providing cool water from a hot water supply to a toilet which comprises: a first fluid conduit having a passage with an inlet and outlet for directing cold flush water into the toilet and with an intermediate opening in the conduit into the passage; first check valve means mounted adjacent to the inlet of the first fluid conduit to the passage; a second fluid conduit mounted on and closing the opening in the first fluid conduit; a thermostat means mounted in the second fluid conduit which is open when the water is cool and closed when the water is hot; second check valve means mounted in the second fluid conduit preventing the flow of the water through the intermediate opening and out of the second conduit and allowing flow of the water into the second conduit wherein the control unit allows cool water from a hot water supply to flow through the second conduit until the water becomes heated and then the thermostat means closes the second conduit when hot water moves through the second fluid conduit to the first fluid conduit and thereafter water is supplied only to the toilet through the passage between the inlet and outlet of the first fluid conduit; pipes supplying cold water to the inlet to the passage through the first fluid conduit and cool water in a hot water supply to the second fluid supply conduit; and a flush toilet having a flush water supply line with the first conduit of the circuit mounted in the supply line, wherein cool water from the hot water supply flows through the second fluid conduit to the first fluid conduit until the thermostat means closes the first fluid conduit; flushing the toilet such that cool water from the hot water supply flows through the second fluid conduit to the first fluid conduit until hot water closes the thermostat means in the second fluid conduit.

The valve means of the control unit is preferably manually operable in order that the control unit may be turned on during the period the bathroom is to be used for washing such as in the morning. It will be appreciated that the first check valve opens at a water pressure of at least 5 PSIG higher than the second check valve such as to allow the water in the second fluid conduit to flow into the passage of the first fluid conduit when the thermostat means is open and the control unit is on. Preferably, the thermostat means has a temperature responsive fill material surrounded by a housing. The heat from the water expands the fill material which moves the housing and closes off the second fluid conduit, thereby preventing water from flowing from the second fluid conduit into the passage of the first fluid conduit.

Figure 2:
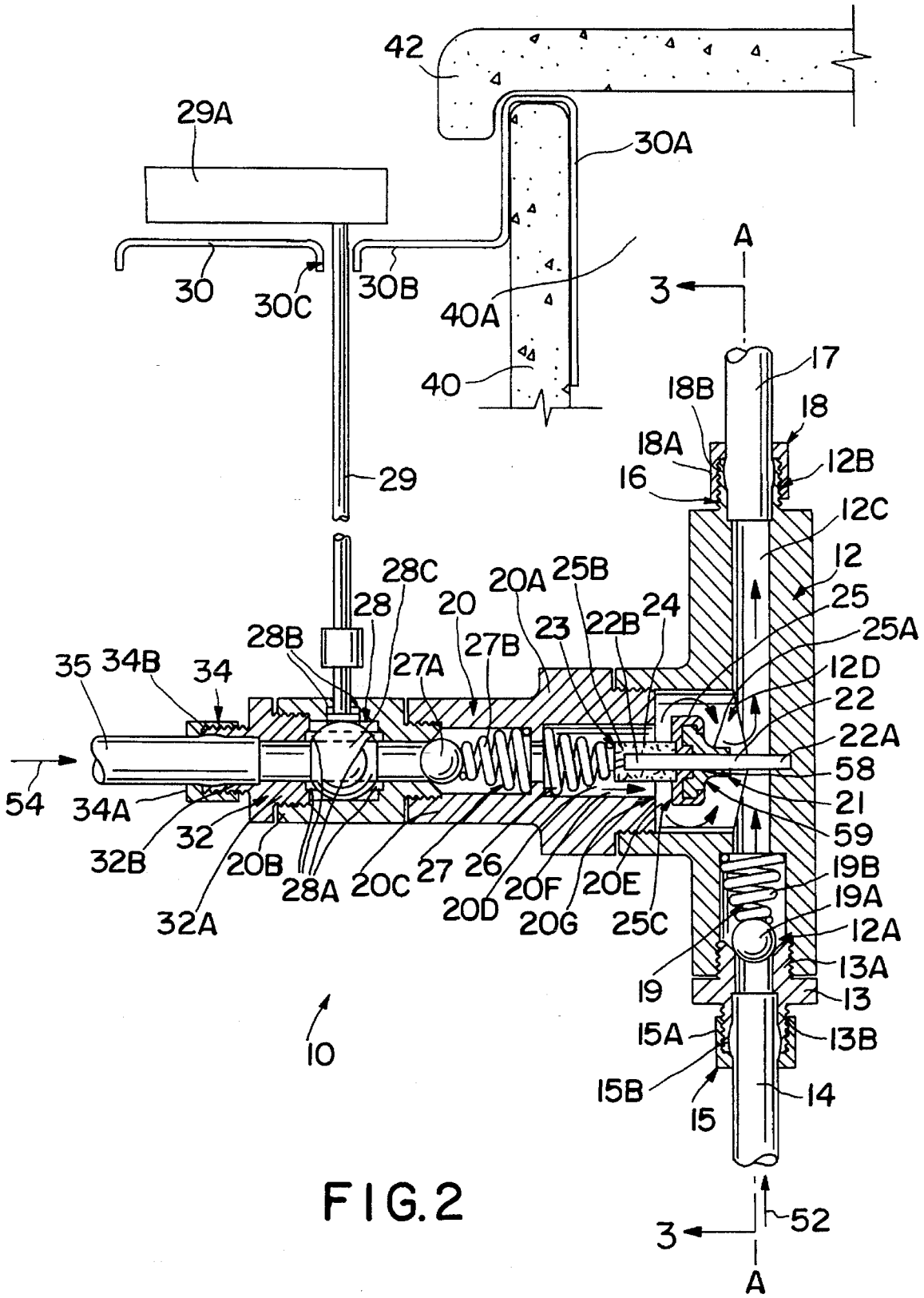
FIG. 2 is a cross-sectional view showing the manually operated valve 28 the second check valve 27 and the thermostatic device 21 of the second fluid conduit 20 and the first check valve 19 of the first fluid conduit 12.
Figure 3:
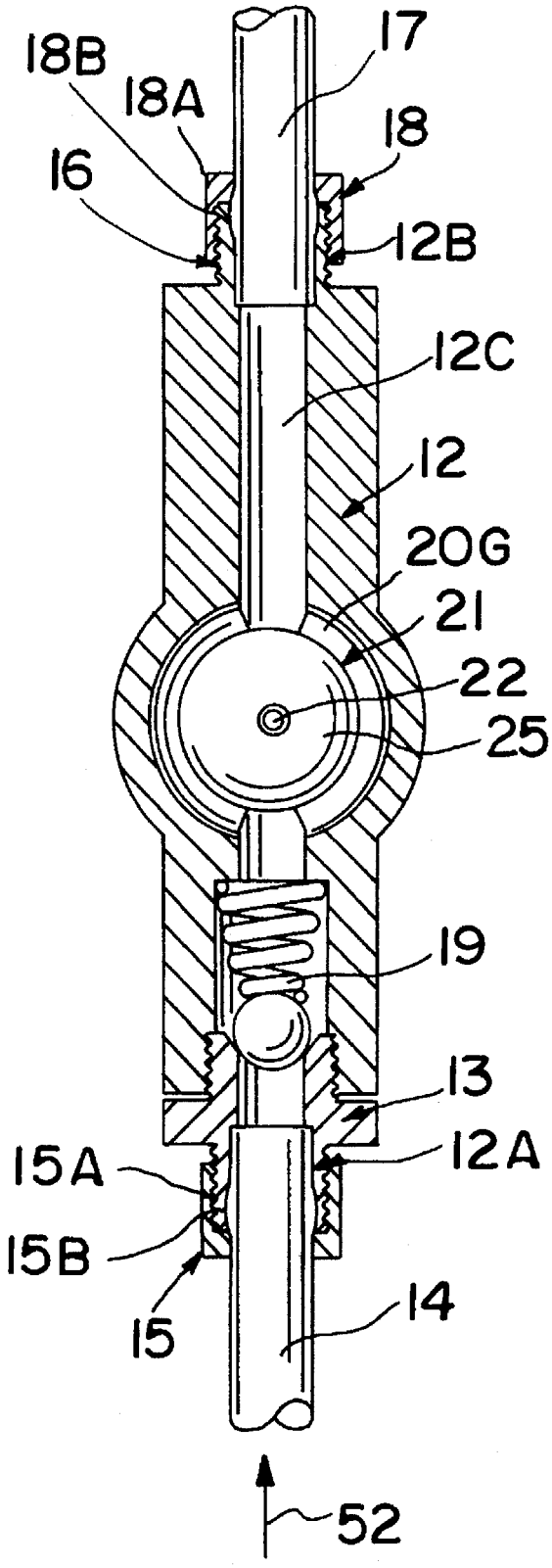
FIG. 3 is a cross-sectional view of FIG. 2 along line 3—3 showing the housing 25 and the rod 22 of the thermostatic device 21.
Figure 4:
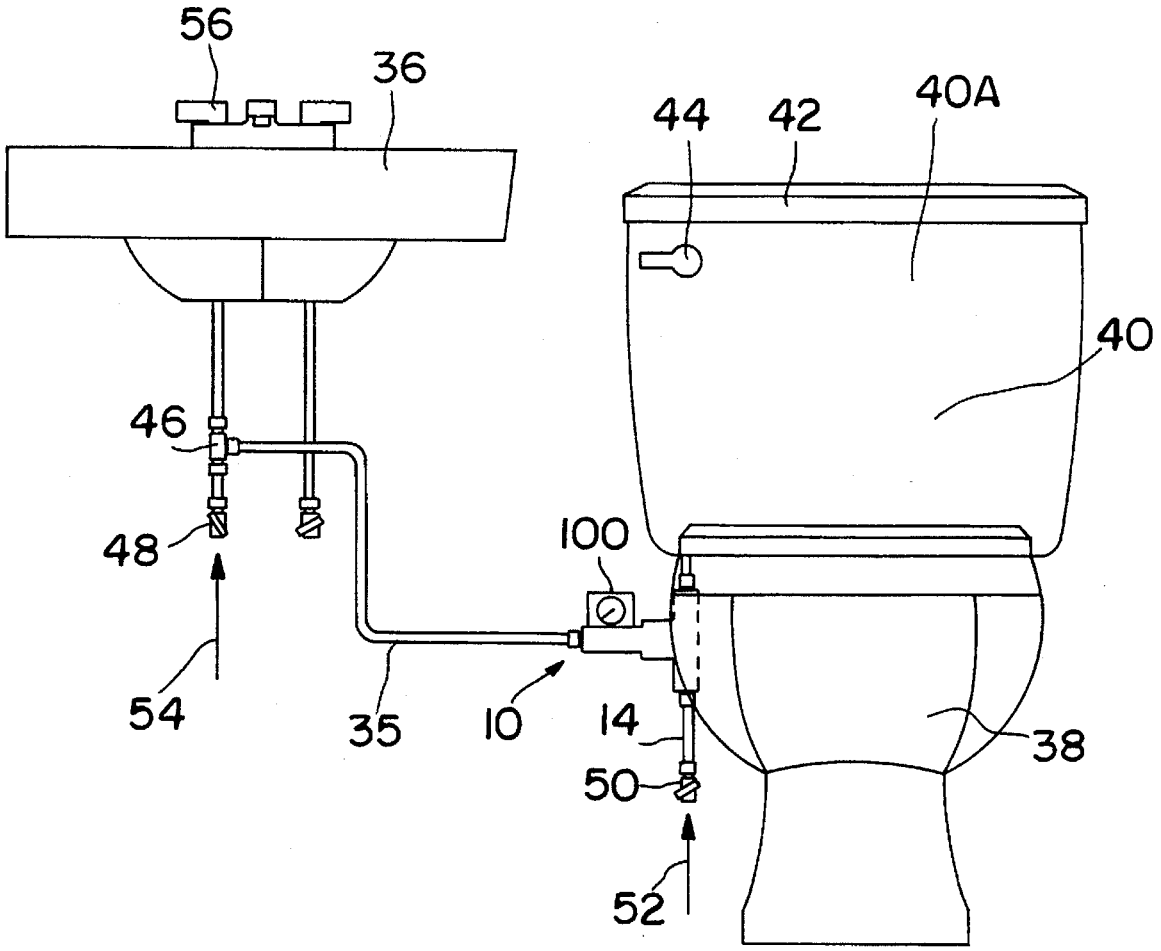
FIG. 4 is a front view of the conventional bathroom plumbing system with a toilet 38 and a lavatory 36 and with a T-shaped control unit 10 having a timing unit 100.

FIGS. 1 to 3 show a water conservation system. The system is comprised of a hot water supply 54 and a cold water supply 52, a lavatory 36, a bathtub (not shown) or a similar hot water receiving device, a toilet 38 with a toilet flush tank 40, a toilet flush water supply control unit 10 and an auxiliary conduit 35 connecting the toilet flush water supply control unit 10 to the hot water system. FIG. 2 shows the flow of water through the system by means of arrows.

As shown by FIG. 1, the control unit 10 forms a tee located between the hot water supply 54, the cold water supply 52 and the toilet flush tank 40. The control unit 10 is comprised of a first fluid conduit 12 and a second fluid conduit 20 (FIG. 2).

The first fluid conduit 12 has an inlet 12A and a outlet 12B with a passage 12C therebetween and an intermediate opening 12D into the passage 12C (FIG. 2). The first fluid conduit 12 is located along the axis A—A immediately below the toilet flush tank 40 with the inlet 12A of the first fluid conduit 12 extending downward toward the cold water supply 52 and the outlet 12B of the first fluid conduit 12 extending upward toward the toilet flush tank 40. Preferably, the first fluid conduit 12 is located within the plumbing system which is normally used to supply cold water 52 to the toilet flush tank 40. The inlet 12A of the first fluid conduit 12 is capped by a first attachment fitting 13 which has a threaded first end 13A and a threaded second end 13B (FIG. 2). The threaded first end 13A is threadably mated into the inlet 12A of the first fluid conduit 12. The threaded second end 13B extends downward from the first fluid conduit 12 and mounts a first compression fitting 15 having an outer portion 15A and a compression sleeve 15B such that the lower original conduit 14 of the toilet 38 is inserted into the compression sleeve 15B and inside the threaded second end 13B of the first attachment fitting 13 (FIGS. 2 and 3). The outer portion 15A of the first compression fitting 15 is mounted over the lower original conduit 14 of the toilet 38 and is threadably mated onto the threaded second end 13B of the first attachment fitting 13 to secure the lower original conduit 14 into the threaded second end 13B of the first attachment fitting 13. The compression sleeve 15B of the first compression fitting 15 compresses upon the threading of the outer portion 15A onto the threaded second end 13B of the first attachment fitting 13 and acts to seal off the union of the first attachment fitting 13 of the first fluid conduit 12 and the lower original conduit 14 of the toilet 38 to effect a watertight seal.

The outlet 12B of the first fluid conduit 12 has a threaded end 16 which extends upward toward the toilet flush tank 40 wherein the upper original conduit 17 of the toilet 38 is inserted into the threaded end 16 of the first fluid conduit 12. The threaded end 16 of the outlet 12B mounts a second compression fitting 18 having an outer portion 18A which is mounted over the upper original conduit 17 of the toilet 38 and is threadably mated onto the threaded end 16 of the first fluid conduit 12 to secure the upper original conduit 17 into the outlet 12B of the first fluid conduit 12 (FIGS. 2 and 3). The compression sleeve 18B of the second compression fitting 18 compresses upon the threading of the outer portion 18A onto the threaded end 16 of the first fluid conduit 12 and acts to seal off the union of the threaded end 16 of the first fluid conduit 12 and the upper original conduit 17 of the toilet 38 to effect a watertight seal.

As shown in FIG. 2, a first check valve 19 is mounted in the inlet 12A of the first fluid conduit 12 adjacent the threaded first end 13A of the first attachment fitting 13. The first check valve 19 is preferably controlled by the variation in water pressures such that as the water pressure in the passage 12C of the first fluid conduit 12 decreases, the pressure of the cold water in the lower original conduit 14 pushes the first check valve 19 open, thus allowing the cold water to flow through the passage 12C of the first fluid conduit 12 and into the toilet flush tank 40. The decrease in water pressure in the first fluid conduit 12 upstream from the first check valve 19 is caused by a reduction in the amount of cool water from the second fluid conduit 20 flowing through the intermediate opening 12D (to be discussed in detail hereinafter). The activation pressure of the first check valve 19 is preferably at least 5 PSI higher than the second check valve 27 (to be described in detail hereinafter, such that if the passage 12C of the first fluid conduit 12 is full of cool water, the pressure of the cool water and the activation pressure of the first check valve 19 are greater than the pressure of the cold water in the lower original conduit 14 pushing upward on the opposite side of the first check valve 19, thus the pressure of the cold water is not enough to open the first check valve 19.

A second fluid conduit 20 has a proximal portion 20A, a central portion 20C and a distal portion 20B and is mounted such that the proximal portion 20A is adjacent the intermediate opening 12D of the first fluid conduit 12 perpendicular to the axis A—A (FIG. 2). The proximal portion 20A of the second fluid conduit 20 extends into the intermediate opening 12D in the first fluid conduit 12. The passage 20D of the proximal portion 20A of the second fluid conduit 20 has an enlarged portion 20E and a narrow portion 20F. The enlarged portion 20E is located adjacent to the intermediate opening 12D of the first fluid conduit 12 and the narrow portion 20F is located between the enlarged portion 20E and the second check valve 27 (to be described in detail hereinafter). The inner diameter of the enlarged portion 20E is larger than the inner diameter of the narrow portion 20F such that a shoulder 20G is formed wherein the enlarged portion 20E and the narrow portion 20F of the passage 20D of the proximal portion 20A of the second fluid conduit 20 meet (FIG. 2).

A thermostatic device 21 having a housing 25, a fill material 23 and a support rod 22 is mounted within the passage 20D of the proximal portion 20A of the second fluid conduit 20 (FIG. 2). The housing 25 has a first portion 25A and a second portion 25B wherein the fill material 23 is located within the second portion 25B of the housing 25 and a shoulder 25C is formed wherein the second portion 25B of the housing 25 overlaps the first portion 25A of the housing 25. The thermostatic device 21 is located within the proximal portion 20A of the second fluid conduit 20 such that the first portion 25A of the housing 25 is within the enlarged portion 20E of the passage 20D of the proximal portion 20A and wherein the second portion 25B of the housing 25 extends outward from the first portion 25A perpendicular to the axis A—A and into the narrow portion 20F of the passage 20D of the proximal portion 20A of the second fluid conduit 20.

The rod 22 has a first end 22A and a second end 22B and is mounted perpendicular to the axis A—A such that the first end 22A of the rod 22 is secured within the first fluid conduit 12 and such that the second end 22B of the rod 22 extends outward from the first fluid conduit 12 through the first portion 25A and into the second portion 25B of the housing 25. The rod 22 is intended to provide support for the thermostatic device 21 through attachment to the first fluid conduit 12. The first portion 25A of the housing 25 preferably only forms a guide for the rod 22 through the housing 25 wherein the second portion 25B of the housing 25 contains the activation mechanism for the thermostatic device 21. As shown in FIG. 2, the second end 22B of the rod 22 extends into the second portion 25B of the housing 25 wherein the rod 22 is surrounded by the fill material 23. In the preferred embodiment, the second end 22B of the rod 22 is encased in an elastomer sleeve 24 which forms a protective barrier between the rod 22 and the fill material 23. Additionally, a washer 58 can be placed around the rod 22 between the first and second portions 25A and 25B of the housing 25. A spring 26 is mounted in the narrow portion 20F of the passage 20D of the proximal portion 20A of the second fluid conduit 20 to assist in the operation of the thermostatic device 21. The thermostatic device 21 can be purchased at Actronics, Inc., Control Instruments & Devices, Waltham, Massachusetts. A thermal insulation barrier (rubber) 59 can be applied to the device 21 to minimize the cooling effects of the cold water through the first fluid conduit 12.

The thermostatic device 21 is controlled by the temperature of the water in the second fluid conduit 20. When the water in the second fluid conduit 20 is cool, the thermostatic device 21 is open as shown in FIG. 2, thus allowing the cool water in the second fluid conduit 20 to flow through the intermediate opening 12D into the first fluid conduit 12 and eventually into the toilet flush tank 40. The cool water is from hot water which has been in the hot water piping system long enough to have cooled down. Once the supply of cool water in the second fluid conduit 20 has been exhausted, the water in the second fluid conduit 20 is then hot water. Accordingly, once the hot water contacts the thermostatic device 21, the thermostatic device 21 closes and stops the flow of water from the second fluid conduit 20 through the intermediate opening 12D and into the first fluid conduit 12. The thermostatic device 21 operates such that when the hot water contacts the thermostatic device 21, the fill material 23 expands within the rigid second portion 25B of the housing 25 and pushes against the stationary second end 22B of the rod 22 thus causing the housing 25 of the thermostatic device 21 to move toward the shoulder 20G of the proximal portion 20A of the second fluid conduit 20. Preferably, the fill material 23 is comprised of a material such as a heat sensitive wax material intermixed with copper pieces as a heat transfer agent which has a high degree of volumetric expansion and which reacts to temperature changes. The composition of the fill material 23 allows the fill material 23 to expand when in the presence of the hot water and helps to form a tight seal between the shoulder 25C of the housing 25 and the shoulder 20G of the passage 20D of the proximal portion 20A of the second fluid conduit 20. Accordingly, when cool water contacts the thermostatic device 21, the fill material 23 of the thermostatic device 21 contracts such that the shoulder 25C of the housing 25 moves away from the shoulder 20G of the passage 20D which opens the thermostatic device 21 and allows water to flow from the second fluid conduit 20 into the passage 12C of the first fluid conduit 12. The spring 26 aids in opening the thermostatic device 21 by pushing the shoulder 25C of the housing 25 away from the shoulder 20G of the passage 20D as the fill material 23 contracts.

In the closed position, the thermostatic device 21 prevents hot water from entering the first fluid conduit 12 and thus from entering the toilet flush tank 40 and being used to flush the toilet 38. Once the flow of water between the first fluid conduit 12 and the second fluid conduit 20 is stopped, the hot water supply 54 is held in the hot water piping system. By diverting the cool water in the hot water system to the toilet flush tank 40, hot water is able to be present instantly upon turning on the hot water faucet 56 (FIG. 1). Once all the cool water has been diverted to the toilet flush tank 40, any additional water needed to fill the toilet flush tank 40 is provided by the cold water supply 52 through the inlet 12A of the first fluid conduit 12. Once the thermostatic device 21 has closed, the water pressure in the first fluid conduit 12 decreases due to the lack of water flow from the second fluid conduit 20 into the first fluid conduit 12. A decrease in the water pressure in the first fluid conduit 12 causes the first check valve 19 to open and allows cold water from the cold water supply 52 to flow through the first fluid conduit 12 into the toilet flush tank 40.

A second check valve 27 is mounted in the central portion 20C of the second fluid conduit 20 adjacent the thermostatic device 21 (FIG. 2). The second check valve 27 prevents water from flowing from the first fluid conduit 12 through the intermediate opening 12D and through the second fluid conduit 20 into the auxiliary conduit 35. Thus, cold water is prevented from entering the hot water piping system when the thermostatic device 21 is in an open position (FIG. 2). The second check valve 27 is used only to prevent the backward flow of water through the second fluid conduit 20, therefore the activation pressure of the second check valve 27 must be less than the pressure of the cool water in the distal portion 20B of the second fluid conduit 20. The pressure of cool water in the second fluid conduit 20 is the standard pressure of water in a regular plumbing system which is usually about 50 PSIG. In the preferred embodiment, both the first and second check valves 19 and 27 are comprised of a ball 19A and 27A biased by a spring 19B and 27B, respectively.

As shown in FIG. 2, a valve 28 is mounted in the distal portion 20B of the second fluid conduit 20 between the second check valve 27 and the second attachment fitting 32 (to be described in detail hereinafter). The valve 28 turns the control unit 10 on and off. When in the closed position, the valve 28 prevents cool water or hot water whichever is present in the auxiliary conduit 35, from entering the second fluid conduit 20. Thus, when the control unit 10 is off, the system functions similarly to an ordinary bathroom plumbing system. Preferably, a user only opens the valve 28 when there is a need for hot water such as in the morning, when it is desired to take a shower and the toilet 38 is to be used first. As shown in FIG. 2, the valve 28 is preferably a manually operated standard ball valve which contains first seals 28A and second seals 28B. The first seals 28A are located above and below the ball 28C of the valve 28 on either side of the ball 28C. The first seals 28A prevent water from leaking around the ball 28C as the water passes through the valve 28. The second seals 28B are located adjacent the top of the valve 28 and around the handle 29 (to be described in detail hereinafter) of the valve 28 wherein the handle 29 is mounted onto the valve 28. The second seals 28B prevent water from leaking from the valve 28 and consequently the control unit 10, through the handle 29 of the valve 28.

In the preferred embodiment, a handle 29 extends upward from the valve 28 parallel to the axis A—A and is connected by a bracket 30 to the top of the toilet flush tank 40 (FIG. 2). The bracket 30 has a hook portion 30A which hooks over the inside of the toilet flush tank 40 such that the tank lid 42 holds the bracket 30 in place. A side portion 30B extends perpendicular to the side of the toilet flush tank 40 adjacent the portion of the front 40A of the toilet flush tank 40 which contains the toilet flush lever 44 spaced downward from the tank lid 42 (FIG. 1). The side portion 30B, of the bracket 30, has an aperture 30C in the plane parallel to the axis A—A. The handle 29 extends upward through the aperture 30C in the bracket 26 such that the indicating lever 29A of the handle 29 extends above the bracket 30 (FIG. 2). The position of the handle 29 of the valve 28 is convenient for turning the system on and off and also acts as a reminder to turn the system on before flushing the toilet 38 if hot water is to be used in the near future. The handle 29 allows the valve 28 to be manually opened and closed thus allowing the user to control when the cool water is to be used to flush the toilet 38. Preferably, a quarter turn of the indicating lever 29A will open or close the valve 28. A label applied to the top surface of bracket 30 indicates the open and closed positions of the valve 28.

The distal portion 20B of the second fluid conduit 20 is capped by a second attachment fitting 32 which has a threaded first end 32A and a threaded second end 32B. The threaded first end 32A is threadably mated into the distal portion 20B of the second fluid conduit 20 adjacent the valve 28 opposite the second check valve 27. The threaded second end 32B extends outward from the second fluid conduit 20 perpendicular to the axis A—A and mounts a third compression fitting 34 having an outer portion 34A and a compression sleeve 34B wherein the auxiliary conduit 35 is inserted into the threaded second end 32B of the second attachment fitting 32. The outer portion 34A of the third compression fitting 34 is mounted over the auxiliary conduit 35 and is threadably mated onto the second attachment fitting 32 to secure the auxiliary conduit 35 into the second attachment fitting 32 of the second fluid conduit 20. The compression sleeve 34B of the third compression fitting 34 compresses upon threading of the outer portion 34A of the third compression fitting 34 onto the threaded second end 32B of the second attachment fitting 32 and acts to seal off the union of the second attachment fitting 32 of the second fluid conduit 20 and the auxiliary conduit 35 to effect a watertight seal. In the preferred embodiment, the compression sleeves 15B, 18B and 34B of the compression fittings 15, 18 and 34 are made of brass.

The auxiliary conduit 35 extends outward from the control unit 10 and into a tee 46 situated between the hot water supply 54 and the hot water faucet 56 (FIG. 1). Preferably, the auxiliary conduit 35 enters the hot water supply 54 near the hot water faucet 56 such that most of the cool water in the hot water supply 54 is diverted to the control unit 10 and drained into the toilet flush tank 40. Thus, when the hot water faucet 56 is turned on, only a minimal amount of cool water needs to be drained before hot water is available.

As shown in FIG. 1, a first standard valve 48 is located in the hot water piping system below the tee 46. The first standard valve 48 controls the flow of hot water from the hot water supply 54 into the hot water piping system. A second standard valve 50 is located in the lower original conduit 14 between the cold water supply 52 and the control unit 10 and controls the flow of cold water from the cold water supply 52 into the cold water toilet system. Preferably, the first and second standard valves 48 and 50 are those which are normally present in the bathroom plumbing system before installation of the control unit 10. The first and second standard valves 48 and 50 are used to stop the flow of hot water and cold water respectively into the bathroom plumbing system such that the control unit 10 may be installed.

IN USE

To turn the system on, the indicating lever 29A, of the handle 29 of the valve 28, is rotated in the correct direction to open the valve 28. To achieve the best results, the control unit 10 should be activated before use of the bathroom begins. However, as long as the system is activated close to the time the toilet 38 is flushed, and definitely before the hot water is used, the system will conserve water and provide hot water instantly to the hot water faucets in the bathroom. The control unit 10 is only useful when there is cool water present in the hot water system. A good example of when the present invention is most useful is in the morning before first use of the bathroom.

Once the valve 28 is open, water from the hot water supply 54 is allowed to flow freely into the control unit 10 adjacent to the thermostatic device 21. The thermostatic device 21 then determines whether the incoming water is hot or cool. Since the opening and closing of the thermostatic device 21 is controlled by the temperature of the water in the second fluid conduit 20, when not needed the thermostatic device 21 of the control unit 10 will open and remain open once the water which remains in the second fluid conduit 20 has cooled down. When the water entering the control unit 10 from the second fluid conduit 20 is cool, the thermostatic device 21 in the control unit 10 remains open allowing the cool water from the second fluid conduit 20 to enter the first fluid conduit 12 through the intermediate opening 12D and upward into the toilet flush tank 40.

In the preferred embodiment, the valve 28 is opened prior to or simultaneously with the flushing of the toilet 38. Therefore, when the toilet 38 is flushed and the toilet flush tank 40 requires filling, the water to fill the toilet flush tank 40 is available from the cool water in the second fluid conduit 20. As long as the thermostatic device 21 remains open and cool water is available, the water needed to fill the toilet flush tank 40 will be supplied by the cool water in the second fluid conduit 20. The first check valve 19 in the first fluid conduit 12 prevents the cool water from going down the first fluid conduit 12 in the direction of the cold water supply 52 and prevents cold water from entering the second fluid conduit 20 from the first fluid conduit 12 when cool water under pressure is present. The cool water from second fluid conduit 20 continues to flow into the toilet flush tank 40 until either the toilet flush tank 40 reaches its full capacity or all the cool water has been diverted and hot water expands the thermostatic device 21. Due to the large capacity of current toilet flush tanks 40, the amount of cool water available is usually less than that needed to completely fill the toilet flush tank 40 once. When the cool water in the hot water system is exhausted, the hot water enters the second fluid conduit 20 and is sensed by the thermostatic device 21 which closes, shutting off the flow of water from the second fluid conduit 20 through the intermediate opening 12D and into the first fluid conduit 12. The remaining water needed to fill the toilet flush tank 40 is then provided by the cold water supply 52 in response to the opening of the first check valve 19. When the thermostatic device 21 is closed, the water needed by the toilet flush tank 40 is supplied through the first fluid conduit 12 from the cold water supply 52 as is usually done in ordinary toilet systems. Closure of the thermostatic device 21 indicates that hot water has completely replaced the cool water in the hot water system. Thus, upon turning on any hot water faucet 56 in the bathroom hot water will be immediately available.

In an alternate embodiment (not shown), the valve 28 is controlled by a timing unit 100 such that the timing unit 100 turns the valve 28 on and activates the control unit 10 at a preset time. Preferably, the timing unit 100 will turn the control unit 10 on before the toilet 38 is flushed and before the hot water is needed. Additionally, the timing unit 100 would turn off the control unit 10 automatically after a preset time interval. The timing unit 100 could be adjusted to allow operation of the system during either the morning or evening bathing times, or both, without manual intervention.

The first check valve 19 and the second check valve 27 can also have different embodiments. For instance, the first and second check valves 19 and 27 can be flutter valves (not shown). In addition, the thermostatic device 21 may be another type other than that of the preferred embodiment.

The device of the present invention saves water by not having cooled water in the hot water system go down the drain. At the same time, the device of the present invention provides convenience in use.

It is intended that the foregoing description be only illustrative of the present invention and that the present invention be limited only by the hereinafter appended claims.

I claim:

1. A toilet flush water supply control unit which comprises:

(a) a first fluid conduit having a passage with an inlet and outlet for directing cold flush water into a toilet and with an intermediate opening in the conduit into the passage;

(b) a first check valve means mounted adjacent to the inlet of the first fluid conduit to the passage for controlling the flow of the cold flush water into the passage;

(c) a second fluid conduit mounted on and closing the intermediate opening in the first fluid conduit;

(d) a thermostat means mounted in the second fluid conduit for controlling the flow of water from a hot water supply into the passage which is controlled by the temperature of the water from the hot water supply to the thermostat means such that the thermostat means is open when the water from the hot water supply is cool and closed when the water is hot; and (e) a second check valve means mounted in the second fluid conduit preventing the flow of the cold flush water through the intermediate opening and out of the second fluid conduit and allowing flow of the water from the hot water supply into the second fluid conduit wherein the control unit allows cool water from the hot water supply to flow through the second fluid conduit until the water becomes heated and then the thermostat means closes the second fluid conduit when hot water moves through the second fluid conduit to the first fluid conduit and thereafter only cold flush water is supplied to the toilet through the passage between the inlet and outlet of the first fluid conduit and wherein the first check valve means is closed when the thermostat means is open and water from the hot water supply is flowing through the second check valve means and past the thermostat means.

2. The unit of claim 1 wherein a third valve means is mounted in the second fluid conduit operable for selective opening and closing of the second fluid conduit.

3. The unit of claim 2 wherein the third valve means is adapted to be mounted adjacent to the toilet and is manually operable.

4. The unit of claim 1 wherein the thermostat means has a fill material surrounded by a housing which is moved by the fill material and wherein when the fill material is expanded by heated water, the housing closes the second fluid conduit thereby preventing flow of water to the passage in the first fluid conduit from the second fluid conduit.

5. The unit of claim 1 wherein the first check valve means is a ball biased by a coil spring mounted adjacent to the inlet to the passage of the first fluid conduit.

6. The unit of claim 5 wherein the first check valve opens at a water pressure of at least 5 PSI higher than the second check valve such that the water from the second fluid conduit flows into the passage of the first fluid conduit when the thermostat means is open.

7. The system of claim 1 wherein the unit is adapted for connection to a bathroom lavatory water supply line as the hot water supply.

8. A system for providing cool water from a hot water supply to a toilet which comprises:

(a) a first fluid conduit having a passage with an inlet and outlet for directing cold flush water into the toilet and with an intermediate opening in the conduit into the passage; first check valve means mounted adjacent to the inlet of the first fluid conduit to the passage for controlling the flow of the cold flush water into the passage; a second fluid conduit mounted on and closing the opening in the first fluid conduit; a thermostat means mounted in the second fluid conduit for controlling the flow of water from a hot water supply into the passage which is controlled by the temperature of the water from the hot water supply to the thermostat means such that the thermostat means is open when the water is cool and closed when the water is hot; a second check valve means mounted on the second fluid conduit preventing the flow of cold flush water through the intermediate opening and out of the second fluid conduit and allowing flow of the water from the hot water supply into the second fluid conduit wherein the control unit allows cool water from the hot water supply to flow through the second fluid conduit until the water becomes heated and then the thermostat means closes the second fluid conduit when hot water moves through the second fluid conduit to the first fluid conduit and thereafter only cold flush water is supplied to the toilet through the passage between the inlet and outlet of the first fluid conduit and wherein the first check valve means is closed when the thermostat means is open and water from the hot water supply is flowing through the second check valve means and past the thermostat means;

(b) a pipe supplying cold water to the inlet and through the passage of the first fluid conduit to the toilet and a pipe supplying cool water from the hot water supply to the second fluid conduit; and (c) a flush toilet having a flush water supply line with the first fluid conduit of the system mounted in the supply line, wherein cool water from the hot water supply flows through the second fluid conduit to the first fluid conduit until the thermostat means closes the first fluid conduit.

9. The system of claim 8 wherein a third valve means is mounted in the second fluid conduit operable for selective opening and closing of the second fluid conduit.

10. The system of claim 9 wherein the third valve means is mounted adjacent to the toilet and is manually operable.

11. The system of claim 9 wherein the third valve means is mounted adjacent to the toilet and is automatically operable.

12. The system of claim 8 wherein the thermostat means has a fill material surrounded by a housing which is moved by the fill material and wherein when the fill material is expanded by heated water the housing closes the second fluid conduit thereby preventing flow of water the passage in the first fluid conduit from the second fluid conduit.

13. The system of claim 8 wherein the first check valve means is a ball biased by a coil spring mounted adjacent to the inlet to the passage of the first fluid conduit.

14. A method for providing alternate supplies of water to a flush toilet as a result of flushing of the toilet, which comprises:

(a) mounting a control unit for the alternate supplies of water, adjacent to the toilet wherein the control unit comprises: a first fluid conduit having a passage with an inlet and outlet for directing cold flush water into the toilet and with an intermediate opening in the conduit into the passage; first check valve means mounted adjacent to the inlet of the first fluid conduit to the passage for controlling the flow of the cold flush water into the passage; a second fluid conduit mounted on and closing the opening in the first fluid conduit; a thermostat means mounted in the second fluid conduit for controlling the flow of water from a hot water supply into the passage which is controlled by the temperature of the water from the hot water supply to the thermostat means such that the thermostat means is open when the water from the hot water supply is cool and closed when the water is hot; second check valve means mounted in the second fluid conduit for preventing the flow of the cold flush water through the intermediate opening and out of the second fluid conduit and for allowing the flow of the water from the hot water supply into the second fluid conduit, wherein the control unit is mounted adjacent the flush toilet by connecting the inlet of the first fluid conduit to a first pipe for supplying cold water to the toilet and the outlet of the first fluid conduit to a flush water supply line which is connected to the flush toilet and by connecting the second fluid conduit to a second pipe which is connected to the hot water supply; and wherein the control unit allows cool water from the hot water supply to flow through the second fluid conduit until the water becomes heated and then the thermostat means closes the second fluid conduit when hot water moves through the second fluid conduit to the first fluid conduit and thereafter only cold flush water is supplied to the toilet through the passage between the inlet and outlet of the first fluid conduit and wherein the first check valve means is closed when the thermostat means is open and water from the hot water supply is flowing through the second check valve means and past the thermostat means; and (b) flushing the toilet, wherein the control unit controls the supply of the water to the toilet such that cool water from the hot water supply flows through the second fluid conduit to the first fluid conduit until hot water closes the thermostat means in the second fluid conduit and thereafter cold water in the first fluid conduit flows to the toilet.

15. The method of claim 14 wherein a third valve means is mounted in the second fluid conduit operable for selective opening and closing of the second fluid conduit.

16. The method of claim 15 wherein the third valve means is selectively opened or closed so as to allow the cool water from the hot water supply to flow into the first fluid conduit from the second fluid conduit.

17. The method of claim 15 wherein the third valve means is manually operable.

18. The method of claim 15 wherein the third valve means is automatically operable.

19. The method of claim 16 wherein the third valve means is opened during a period when the toilet, a bathtub or a shower having a common hot water and cold water supply is to be used.

20. The method of claim 19 wherein the period is morning or evening.

* * * * *